US010793330B2

(12) United States Patent
Bokovza et al.

(10) Patent No.: US 10,793,330 B2
(45) Date of Patent: Oct. 6, 2020

(54) BUNDLE WITH DIFFERENT INFORMATION LEAFLETS AND METHOD FOR PRODUCING SUCH A BUNDLE

(71) Applicants: Boehringer Ingelheim International GmbH, Ingelheim am Rhein (DE); Eukerdruck GmbH & Co. KG, Marburg (DE)

(72) Inventors: Michal Rachel Bokovza, Ingelheim am Rhein (DE); Robert Maegerlein, Marburg (DE); Thorsten Csellner, Marburg (DE)

(73) Assignees: BOEHRINGER INGELHEIM INTERNATIONAL GMBH, Ingelheim am Rhein (DE); EUKERDRUCK GMBH & CO. KG, Marburg (DE)

( * ) Notice: Subject to any disclaimer, the term of this patent is extended or adjusted under 35 U.S.C. 154(b) by 1059 days.

(21) Appl. No.: 14/178,368

(22) Filed: Feb. 12, 2014

(65) Prior Publication Data

US 2014/0224690 A1 Aug. 14, 2014

(30) Foreign Application Priority Data

Feb. 14, 2013 (EP) ..... 13000750
Mar. 4, 2013 (EP) ..... 13001075

(51) Int. Cl.

| | |
|---|---|
| ***B65D 71/06*** | (2006.01) |
| ***B42D 15/00*** | (2006.01) |
| ***B65H 45/04*** | (2006.01) |
| ***B65H 45/20*** | (2006.01) |

(52) U.S. Cl.

CPC ..... *B65D 71/06* (2013.01); *B42D 15/008* (2013.01); *B65H 45/04* (2013.01); *B65H 45/20* (2013.01); *B42P 2241/02* (2013.01); *B42P 2241/04* (2013.01)

(58) Field of Classification Search

CPC ..... B65D 71/06; B42D 15/008; B65H 45/20; B42P 2241/02; B42P 2241/04

USPC ..... 493/399

See application file for complete search history.

(56) References Cited

U.S. PATENT DOCUMENTS 1,159,459 A * 11/1915 Wood ..... B42D 1/004 281/15.1
3,999,746 A * 12/1976 Gendron ..... B42C 3/00 270/37
4,660,856 A * 4/1987 Shacklett, Jr. ..... B42D 15/00 229/92.1
4,967,951 A * 11/1990 Sherman ..... B65D 27/34 229/314
5,065,992 A 11/1991 Crowley (Continued)

FOREIGN PATENT DOCUMENTS

DE 82 11 399 U1 6/1983
DE 10 2010 027 231 A1 4/2011

(Continued)

*Primary Examiner* — Sameh Tawfik

(74) *Attorney, Agent, or Firm* — David S. Safran; Roberts Calderon Safran & Cole, P.C.

(57) ABSTRACT

A method for producing a bundle (2) of different information leaflets (3, 4) from a sheet of flat material having at least two different sections, and a bundle (2) of such leaflets. The information leaflets (3, 4) are folded jointly and a protruding fold (14) is cut for separation of the information leaflets (3, 4).

9 Claims, 8 Drawing Sheets

(56) References Cited

U.S. PATENT DOCUMENTS 5,104,146 A * 4/1992 Schulz ..... B42D 5/042 281/15.1
5,131,640 A 7/1992 Crowley
5,156,898 A * 10/1992 McDonald ..... B42D 1/006 281/5
5,192,093 A * 3/1993 Zeisky ..... B42C 9/0093 281/15.1
5,348,277 A 9/1994 Crowley
5,360,213 A 11/1994 Crowley et al.
5,791,689 A * 8/1998 Dovel ..... B42D 15/08 281/5
6,029,968 A * 2/2000 Honegger ..... B42C 19/06 270/32
6,811,025 B1 * 11/2004 Kaplan ..... A45C 11/18 150/144
6,837,290 B2 1/2005 Vijuk et al.
D511,793 S * 11/2005 Rittman ..... D19/2
7,018,499 B2 * 3/2006 Furst ..... B42C 3/00 156/211
7,247,130 B2 * 7/2007 Mattila ..... B31D 1/022 493/379
2002/0074386 A1 * 6/2002 Sims ..... B65D 27/28 229/92.1
2003/0037884 A1 * 2/2003 Vijuk ..... B42D 1/006 156/350
2003/0118768 A1 * 6/2003 Sellars ..... B31D 1/021 428/40.1

FOREIGN PATENT DOCUMENTS

JP S 56-63563 U 5/1981
JP 9-95071 A 4/1997
JP H 11-216966 A 8/1999
JP 2004-82678 A 3/2004

* cited by examiner

BUNDLE WITH DIFFERENT INFORMATION LEAFLETS AND METHOD FOR PRODUCING SUCH A BUNDLE

BACKGROUND OF THE INVENTION

Field of the Invention

This invention relates to a method for producing a bundle of different information leaflets and to a bundle with at least two different information leaflets.

Description of Related Art

Information leaflets of the type under discussion bear information which relates typically to a pharmaceutical product or to a drug. Synonymous with the term information leaflet, the names insert and secondary packaging are also often used. These information leaflets can be attached to a package, such as a container of a pharmaceutical product or drug. In this case, the term "outsert" is also often used. Alternatively, information leaflets can be inserted loosely into a box in which there is a pharmaceutical product or a drug.

Conventionally, information leaflets are folded to reduce their size. An information leaflet can be unfolded by a user so that the user, for example, after purchasing the pharmaceutical product or drug, can be aware of the information on the information leaflet, especially can read it.

In many cases, it is necessary to bundle different information leaflets. Thus, for example, the pharmaceutical brand can call for different information leaflets for a pharmaceutical product or drug, the different information leaflets being bundled in a more practical manner.

The different information leaflets can bear, for example, different information, such as handling instructions and regulatory information for the same recipient, for example, a patient. The different information leaflets however can also make available different or identical information for different recipients, for example, patients and medical personnel. The various information leaflets within the scope of this invention can also have identical properties (for example, identical information), but can be intended for a different purposes. Within the scope of this invention, a different purpose is, for example, that one or more information leaflets act as duplicates or copies of another information leaflet.

A method for producing a bundle of different information leaflets and such a bundle are disclosed by DE 10 2010 027 231 A1 which forms the starting point for this invention.

In the known method, a first information leaflet and a second information leaflet which differs from it are bundled. Here, each information leaflet is produced from a separate sheet of paper in a separate process. Each sheet of paper is folded in several folding processes. A fold and a fold layer are formed in each folding process.

In the known method, all fold layers have the same width, i.e., the same extension between one fold and the next fold or an edge which borders the sheet of paper. The folds are aligned to one another, i.e., brought into a line.

After producing several first and second information leaflets, in the known method, the first information leaflets are detached and transferred to a transport device at a relatively great mutual distance. The second information leaflets are first turned by 90° and then deposited in the gaps between two first information leaflets onto the transport device. The sequence of the information leaflets is checked and corrected if necessary by means of a monitoring device.

Using a glue application apparatus, two spots of glue are then applied to the first information leaflet. To detect the type and the position of the information leaflets on the transport device, there is another apparatus which is coupled via a control unit to the glue application apparatus. This ensures that glue spots are applied only to the first information leaflets.

At the end of the transport device there is another monitoring apparatus for checking the glue application on the information leaflets. The monitoring apparatus connected via a control apparatus to a shunt using which faults or improperly glued information leaflets can be separated out. Satisfactory information leaflets are transferred to a stacking apparatus which presses together a glued first information leaflet and an unglued second information leaflet into a bundle. The bundles which have been formed in this way are then delivered to a receiving table.

SUMMARY OF THE INVENTION

The primary object of this invention is to devise a simple method for producing a bundle of different information leaflets and to improve the known method with respect to complexity, costs, time, efficiency, and scrap.

Another object of this invention is to devise a bundle of different information leaflets which is simple to produce and to improve the known bundle with different information leaflets with respect to handling, compactness and/or stability.

The above described objects are achieved by a method or a bundle as described below.

It goes without saying that configurations, embodiments, advantages and the like which are cited below for purposes of avoiding repetition for one aspect of the invention apply accordingly with reference to the other aspects of the invention.

Having said this, this invention is explained in detail below.

In the method in accordance with the invention, the bundle is produced from a sheet of a flat material, especially paper. Therefore, the term "sheet of paper" is mostly used below, even if it can be sheet of some other material. The bundle can also be produced from continuous (indefinite length) paper.

Preferably, the sheet is provided by cutting continuous paper. In addition to paper, carbon fibers which have been processed, for example, into textile structures can also be used as a flat material. It is important that the sheet or the flat material can be folded.

The sheet has at least two different sections which form the different information leaflets. It is important that the different sections of the sheet can be separated from one another. For example, if there is information on the front and the back of a sheet, opposite regions on the front and back should be assigned to the same section.

The sheet is folded in at least two folding processes. Within the scope of this invention the term "folding" is defined as the formation of a fold, i.e., a sharp creased edge (of a fold break) using a tool or a machine.

In the method in accordance with the invention, at least one protruding fold is formed. The term "protruding fold" in accordance with the invention designates a fold which projects or protrudes out of the folded sheet.

The at least one protruding fold is separated in order to separate the information leaflets so that the information leaflets form the bundle. The term "separate", as is used within the scope of this invention, designates a method of production technology in which the coherency of the material which is to be separated is locally neutralized. Accordingly, the separation of the protruding fold, for example, can encompass dividing, especially cutting, but also perforation of the protruding fold.

Therefore, one aspect of this invention comprises forming the different information leaflets from exactly one sheet for producing the bundle, folding this one sheet, and thus, the different information leaflets jointly, and separating this one sheet in the folded state such that the information leaflets are separated and form the bundle. In order to enable separation easily, quickly, economically and precisely, when the sheet is folded at least one protruding fold is formed such that the information leaflets are separated by separation of the protruding fold.

In the method in accordance with the invention, the different information leaflets can be formed from the sheet in a few steps, typically even only one method step. Thus, the method in accordance with the invention reduces the number of method steps which are necessary in the known method, and thus, the production costs and production time.

Furthermore, the method in accordance with the invention leads to a correct arrangement of the different information leaflets in the bundle. A faulty sequence of the different information leaflets, as can occur in the known method, is avoided. Thus, the method in accordance with the invention avoids detection and monitoring of the sequence of the different information leaflets in the bundle. Consequently, the method in accordance with this invention reduces or prevents scrap. Moreover, the method according to this invention reduces the complexity, costs, and time of production.

Additionally, the method in accordance with the invention avoids bringing separate information leaflets together, as in the known method in the form of feed, separation, transfer and gluing together. Thus, the method according to this invention, in turn, reduces the complexity, costs, and time of production as well as eliminating potential fault sources so as to reduce scrap.

The method in accordance with the invention minimizes or reduces interruptions in production. This leads in turn to lower costs and shorter production time.

Altogether the method in accordance with the invention enables simple, economical, less time-consuming, efficient and low-scrap production of the bundle of different information leaflets.

Another aspect of this invention relates to a bundle with at least two different information leaflets. According to this aspect, the information leaflets are folded jointly, especially into one another. The information leaflets have a protruding fold which is cut to separate the information leaflets.

Since the information leaflets are folded jointly for the bundle in accordance with the invention, the bundle in accordance with the invention is very compact or significantly more compact than the known bundle.

The protruding, cut fold of the bundle in accordance with the invention enables easy separation of the different information leaflets by a user, and thus, improves handling.

The jointly folded information leaflets form a stable bundle.

The indicated aspects and features of this invention and the aspects and features of the invention arising from the following description can be implemented independently of one another, but also in any combination.

Other advantages, features, properties, and aspects of this invention will become apparent from the following descriptions of preferred embodiments with reference to the accompanying drawings.

DETAILED DESCRIPTION OF THE INVENTION

To support comprehension, like reference numbers are used for like features in the following explanations of the preferred embodiments of the method in accordance with the invention. The method in accordance with the invention is however not limited to the features which have been provided with reference numbers, but can also be implemented using other features.

Figure 1:
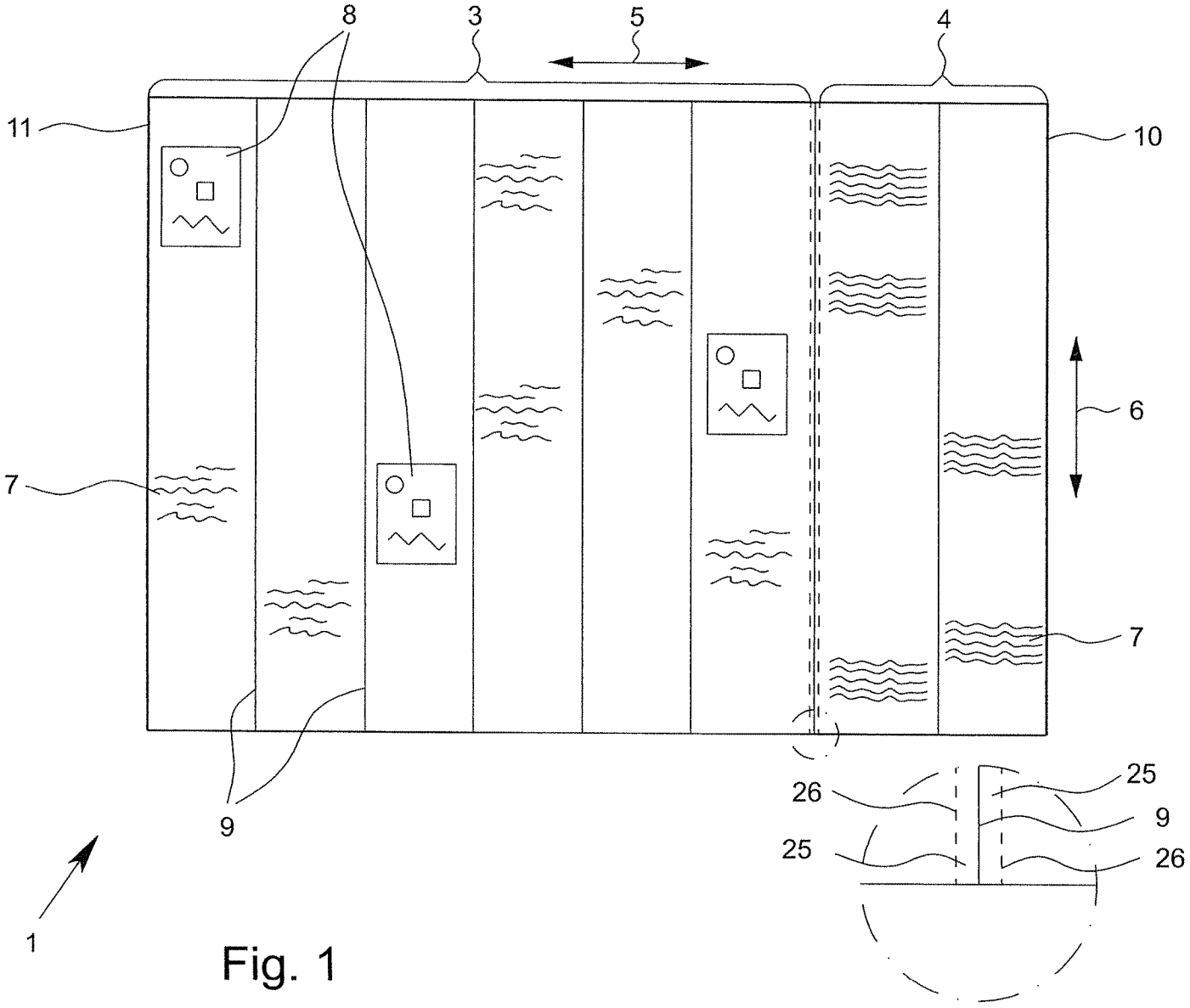
FIG. 1 schematically shows a plan view of a sheet of paper as the initial material for a first preferred embodiment of the method in accordance with the invention with an enlarged detail broken out.
Figure 7:
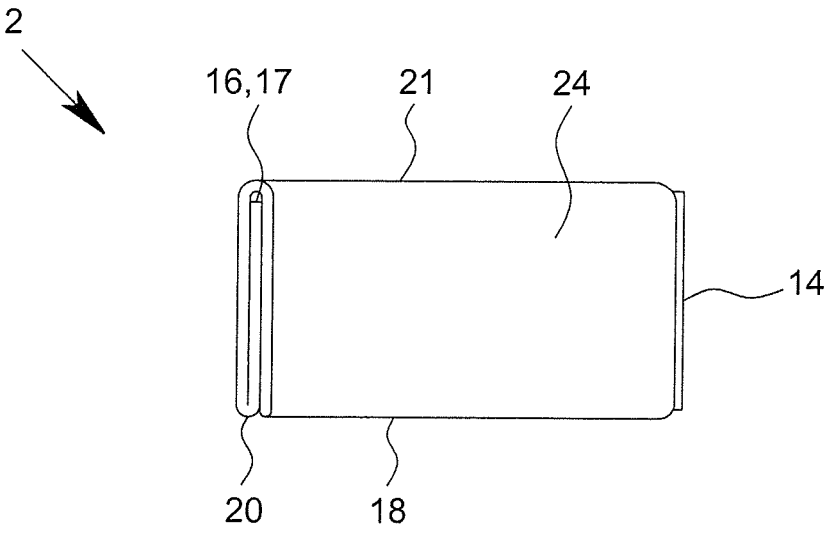
FIG. 7 is a schematic perspective view of a first embodiment of a bundle in accordance with the invention as the final product of the first preferred embodiment of the method in accordance with the invention, FIG. 8 schematically shows a partial folding sequence of a second preferred embodiment of the method in accordance with the invention using a second sheet of paper.

FIG. 1 schematically shows a plan view of a sheet of paper 1. According to a first embodiment of the method in accordance with the invention, a first preferred embodiment of an inventive bundle 2 of a first information leaflet 3 and an information leaflet 4 which differs from the latter, which embodiment is shown in FIG. 7, is produced from the sheet of paper 1.

The sheet of paper 1 has two different sections which form the different information leaflets 3, 4.

In the sheet of paper 1, a longitudinal direction 5 of the sheet of paper 1 runs in the direction of the longest extension of the unfolded sheet of paper 1 and a transverse direction 6 of the sheet of paper 1 runs in the direction of the second-longest extension of the unfolded sheet of paper 1.

The sheet of paper 1 preferably has a rectangular shape. But, sheets with another, for example, round or rectangular shape, can also be used as the initial material for the method in accordance with the invention.

The sheet of paper 1 has an extension in the longitudinal direction 5 of preferably less than 1 m, especially essentially 91 cm or less, and/or in the transverse direction 6, an extension of preferably less than 50 cm, especially essentially 42 cm or less, and/or a thickness of preferably less than 1 mm, especially essentially 0.1 mm or less.

The first information leaflet 3 in the longitudinal direction 5 has an extension of preferably less than 80 cm, especially essentially 69 cm or less. The second information leaflet 4 in the longitudinal direction 5 has an extension of preferably less than 30 cm, especially essentially 22 cm or less. Due to the rectangular shape of the sheet of paper 1, the different information leaflets 3, 4 have the same extension in the transverse direction 6.

Preferably, the different sections, and accordingly, the different information leaflets 3, 4 of the sheet of paper 1 are provided with different information. The different information is especially different texts 7 and/or different graphics, and especially preferably different pictures 8. In the sheet of paper 1 which is shown in FIG. 1, the texts 7 and pictures 8 are shown greatly simplified or abstracted. Preferably, the different information leaflets 3, 4 are designed for different recipients or groups of readers.

The texts 7 and/or pictures 8 are preferably printed on the sheet of paper 1 in block letters. Here, not only the front of the sheet of paper 1 which is shown in FIG. 1, but also the back of the sheet of paper 1 can be printed with texts 7 and/or pictures 8. Here, the division of the texts 7 and/or pictures 8 between the different sections must be taken into account.

The sheet of paper 1 is preferably folded along several folding lines 9. FIG. 1 shows seven folding lines 9 on the sheet of paper 1. The folding lines 9 run preferably in the transverse direction 6 and/or parallel to one another. Preferably, the texts 7 and/or pictures 8 are located in the regions between these folding lines 9 so that more or less several columns with texts 7 and/or pictures 8 result, preferably on the front and the back of the sheet of paper 1.

According to the first preferred embodiment of the method in accordance with the invention, the sheet of paper 1 is folded in several, preferably seven folding processes in the longitudinal direction 5. In doing so, the sheet of paper 1 is folded by means of parallel folding along the parallel folding lines 9.

In the first preferred embodiment of the method in accordance with the invention, a fanfold is used for folding in the longitudinal direction 5. Fanfold is a form of parallel folding in which several regions of the sheet of paper 1 are folded around changing angular directions. In other words, the sheet of paper 1 is folded along the folding lines 9 in alternation toward the front of the sheet of paper 1 and toward the back of the sheet of paper 1. This yields a zigzag-like folding, for which reason this form is also called zigzag folding.

Alternatively, the sheet of paper 1 can also be folded by means of coil folding or altar folding. Coil folding is a form of parallel folding in which several regions of the sheet of paper are folded toward the same side. This yields the coil indicated by the name. Altar folding is a form of parallel folding in which the outer regions of the sheet of paper 1 are folded without overlapping toward the front or back of the sheet of paper 1.

Figure 2:
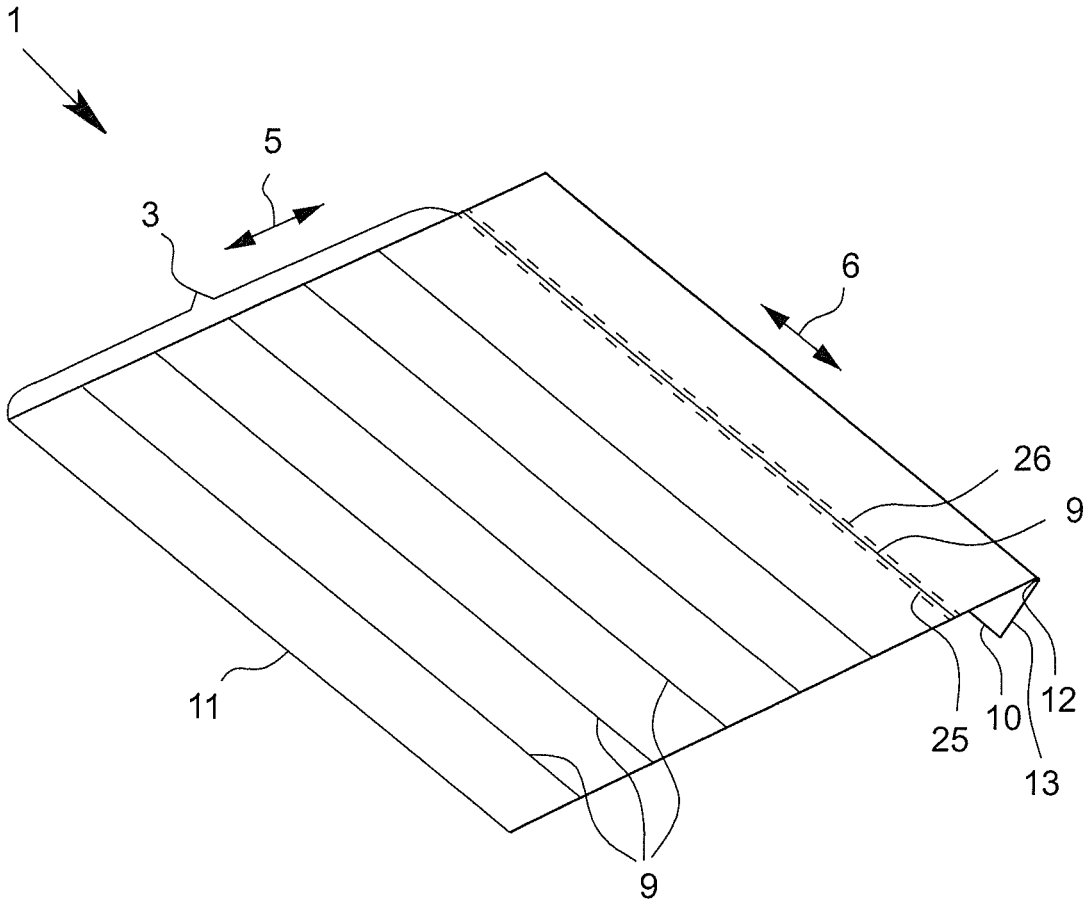
FIG. 2 is a perspective view of the sheet of paper from FIG. 1 as the intermediate product after partial execution of the first preferred embodiment of the method in accordance with the invention, FIG. 3 schematically shows a perspective view of the sheet of paper from FIG. 2 as the intermediate product after a further partial execution of the first preferred embodiment of the method in accordance with the invention

In the first preferred embodiment of the method in accordance with the invention, the sheet of paper 1 is folded beginning at the end 10 of the sheet of paper 1 which is the right end in FIG. 1 along the folding lines 9 which are rightmost in FIG. 1 toward the back of the sheet of paper 1. In doing so, fold 12 and fold layer 13 are formed. The intermediate product of this part of the first preferred embodiment of the method in accordance with the invention is shown schematically in FIG. 2.

Then, the sheet of paper 1 is folded along the other folding lines 9 in alternation toward the front of the sheet of paper 1 and toward the back of the sheet of paper 1.

Preferably, the distances between two folding lines 9 and the outer of the folding lines 9 and the open ends 10, 11 are at least essentially the same except for the two distances between the first and second and second and third folding line 9 viewed from the right in FIG. 1. The latter two distances do at least essentially agree with one another, but are greater than the other distances. The two greater distances in agreement are preferably more than 11.5 cm, especially essentially 11.8 cm, while the other distances are preferably less than 11.5 cm, especially essentially 11.2 cm or less.

Figure 3:
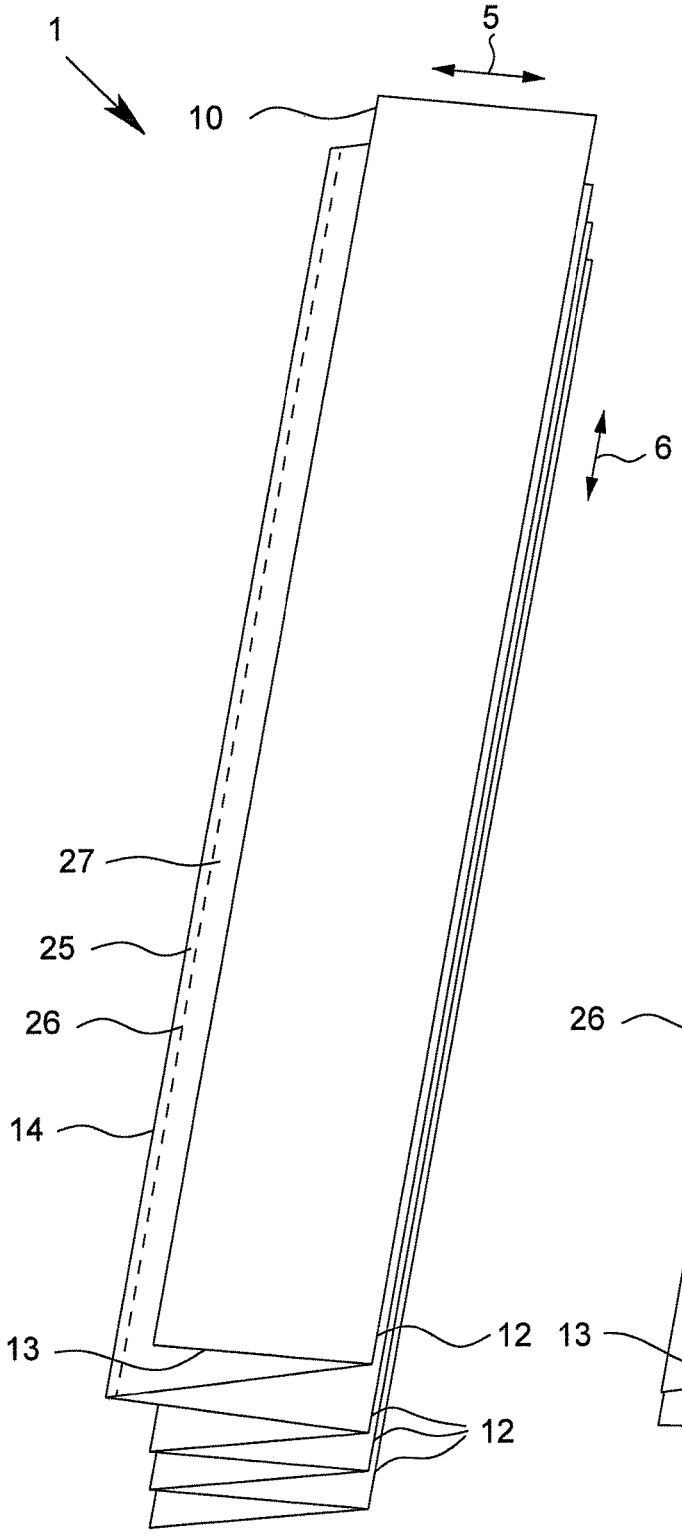
FIG. 3A shows the provision of information on a protruding fold.
Figure 4:
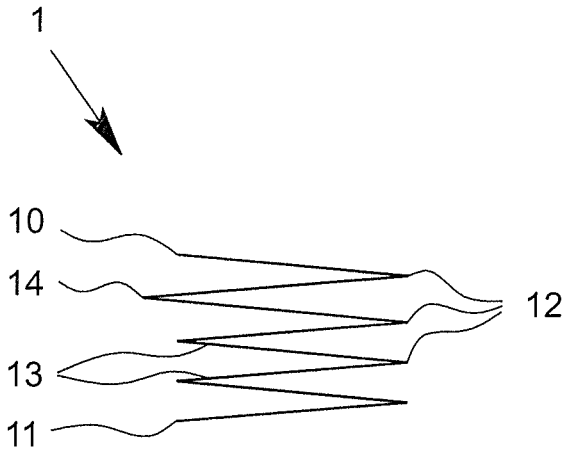
FIG. 4 is a side view schematically showing the sheet of paper from FIG. 3, FIG. 5 schematically shows a partial sequence of the first preferred embodiment of the method in accordance with the invention using the sheet of paper from FIG. 3, FIG. 6 schematically shows a perspective view of the sheet of paper from FIG. 5 as the intermediate product after a further partial execution of the first preferred embodiment of the method in accordance with the invention.

Thus, several, preferably six folds 12 and one protruding fold 14 are formed. FIG. 3 schematically shows a perspective view of the sheet of paper 1 after executing the folding in the longitudinal direction 5 according to the first preferred embodiment of the method in accordance with the invention. FIG. 4 schematically shows a side view of a sheet of paper 1 in this state.

The protruding fold 14 in the longitudinal direction 5 of the sheet of paper 1, in FIG. 3 to the left, projects out of the sheet of paper 1 and sticks out from it. In the first preferred embodiment of the method in accordance with the invention the sheet of paper 1 is folded such that the protruding fold 14 protrudes at least by several mm, especially by essentially 6 mm or more. In FIG. 3, the protrusion or projection of the protruding fold 14 is shown exaggerated for better discernability.

Preferably, the folds 12 are aligned to one another or brought into a line in the longitudinal direction 5, this line running perpendicular to the longitudinal direction 5 and transverse direction 6. Preferably, the protruding fold 14 sticks out relative to this line of the folded sheet of paper 1. If the folds 12 are not brought into a line in the longitudinal direction 5, the protruding fold 14 preferably protrudes relative to the fold or folds 12 which is or are nearer the fold 14.

After fan folding in the longitudinal direction 5, in the first preferred embodiment of the method in accordance with the invention, the already folded sheet of paper 1 is folded transversely, i.e., in the transverse direction 6 of the sheet of paper 1. The partial sequence of the first preferred embodiment of the method in accordance with the invention which is used for this purpose is shown schematically in FIG. 5.

Figure 5:
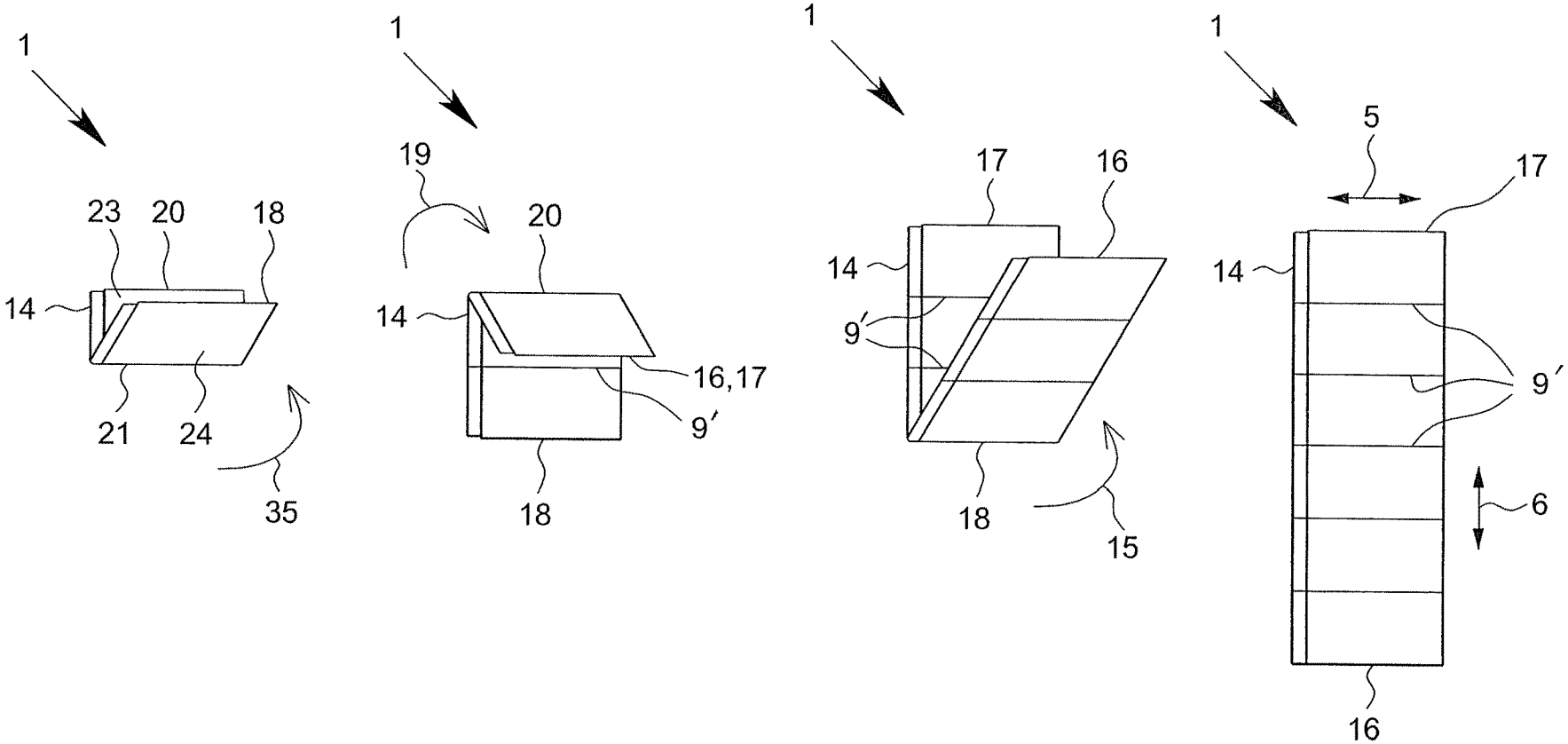

For the sake of better clarity, FIG. 5 shows only one fold layer 13 of the sheet of paper 1 so that the already folded sheet of paper 1 in FIG. 5 appears very thin or even two-dimensional. The fact that folding in the transverse direction 6 increases the thickness of the respective intermediate folded product, remains ignored in FIG. 5. Only the protruding fold 14 is shown greatly simplified in FIG. 5.

On the sheet of paper 1, several, preferably five parallel folding lines 9' running in the longitudinal direction 5 of the sheet of paper 1 are indicated. According to the first preferred embodiment of the method in accordance with the invention, the sheet of paper 1 is first folded by means of parallel folding along the middle one of the five folding lines 9' toward the front of the sheet of paper 1, as indicated by the arrow 15. In doing so the sheet of paper 1 is folded such that one lower edge 16 of the sheet of paper 1 lies on one upper edge 17 of the sheet of paper 1 and is aligned to it. In doing so a first transverse fold 18 is formed.

Then, the sheet of paper 1 which has been folded transversely in this way is in turn folded transversely along one of the folding lines 9', toward the front of the sheet of paper 1 (as indicated by the arrow 19) and such that the edges 16, 17, which lie on one another lie on the other folding line 9 along which has not yet been folded. In doing so, a second transverse fold 20 is formed.

Finally, the sheet of paper 1 which has been folded transversely in this way is folded along the other folding line 9 toward the front of the sheet of paper 1 (as indicated by the arrow 35) such that the first transverse fold 18 lies on the second transverse fold 20 and is aligned to it. In doing so, a third transverse fold 21 is formed.

Preferably, the sheet of paper 1 is detachably sealed after the transverse folding, especially using an adhesive.

Figure 6:
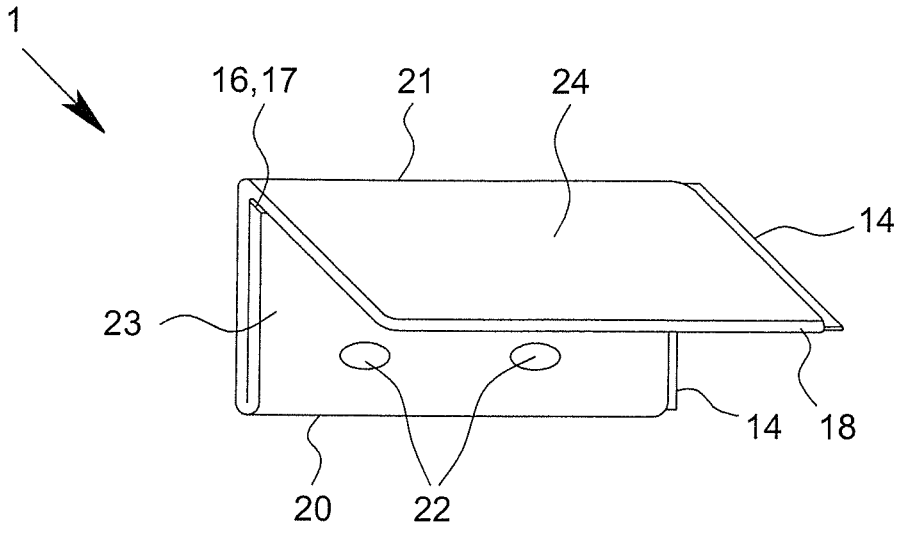

To do this, one or more, preferably two cement spots 22 can be applied to an inner transverse fold layer 23 and an outer transverse fold layer 24 can be pressed onto the inner transverse fold layer 23 and the cement spots 22, as is illustrated in FIGS. 6 & 7.

In the first preferred embodiment, the protruding fold 14 is separated after folding and after sealing of the sheet of paper 1 in order to separate the two information leaflets 3, 4 so that the information leaflets 3, 4 form the bundle 2. To do this, the protruding fold 14 is divided, especially cut. Especially preferably a strip 25 along a cutting line 26 (FIG. 3) is cut off of the protruding fold 14 so that for the two information leaflets 3, 4 one protruding edge region 27 at a time is formed.

The cutting of the protruding fold 14 compared to perforating offers the advantage that the user need not detach the two information leaflets 3, 4 by tearing apart along the perforation. When tearing apart along the perforation, a rip through the remaining sheet of paper 1 and the information on it can arise. This risk does not exist when the protruding fold 14 is cut.

The protruding fold 14 can also be separated before sealing and also between the folding processes.

Figure 3A:
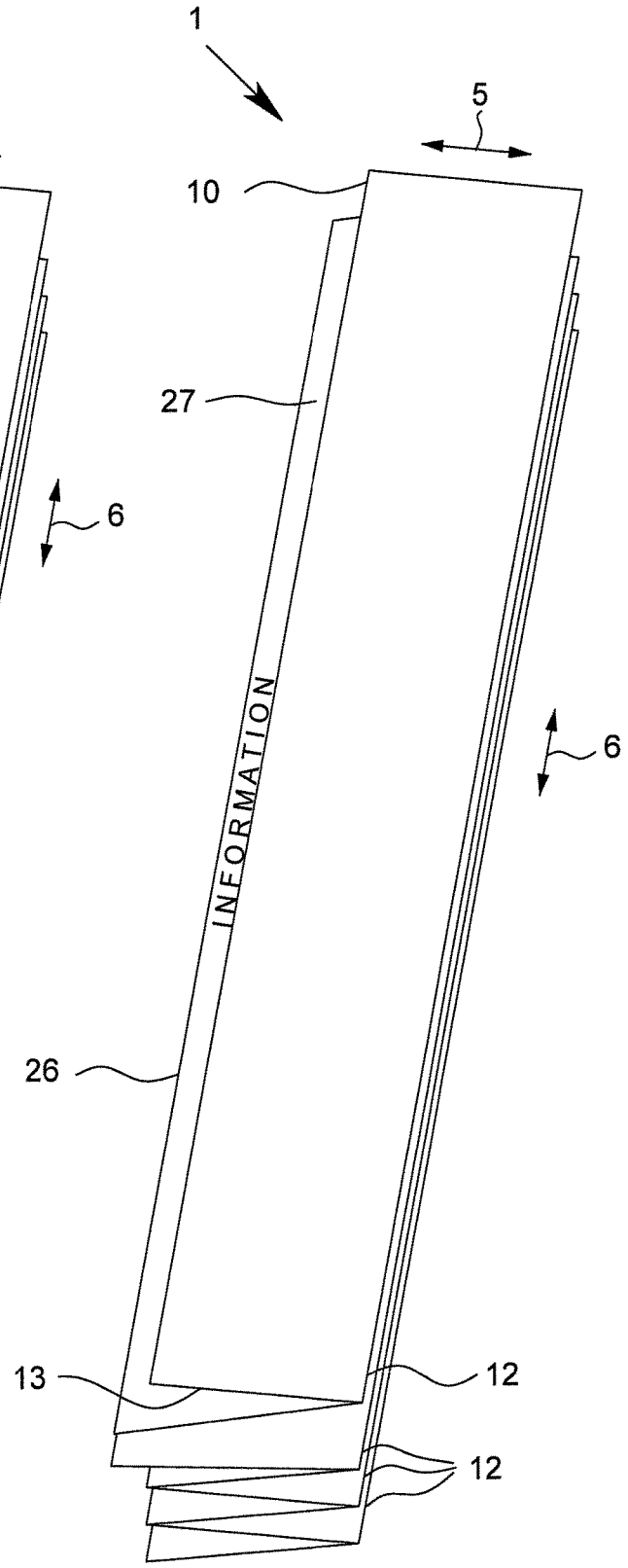

Preferably, there is at least one item of information on the protruding fold 14 as is represented in FIG. 3A. For this reason, during the printing of the unfolded sheet of paper 1, texts 7 and/or pictures 8 can be applied, especially printed, in the regions which ultimately form the protruding edge regions 27. In this case information can be printed in the protruding edge region 27 of the first information leaflet 3 which is other than the information in the protruding edge region 27 of the second information leaflet 4. For example, in the protruding edge region 27 of the first information leaflet 3 information can be printed which indicates the recipient of the first information leaflet 3, conversely information which indicates the recipient of the second information leaflet 4 can be printed in the protruding edge region 27 of the second information leaflet 4.

The protruding edge regions 27 can also be made such that they differ from one another in color. This further facilitates handling of the different information leaflets 3, 4.

The protruding fold 14 or the protruding edge regions 27 can also be worked such that the protruding edge regions 27 have one or more clearances. The clearances are preferably arranged such that the clearances of the protruding edge region 27 of the first information leaflet 3 do not overlap with the clearances of the protruding edge region 27 of the second information leaflet 4. In this way protruding edge regions 27 can be formed which placed on top of one another have the form and function of a register.

It is preferred if the protruding fold 14 is separated such that the information on the protruding fold 14 or the protruding edge regions 27 are visible in the folded state of the bundle 2 and/or after unfolding the bundle 2.

The bundle 2 which has been produced in this way can be opened by a user by the inner transverse fold layer 23 being detached from the outer transverse fold layer 24. After opening the bundle 2, the user can unfold the bundle 2. After unfolding the transverse folds 18, 20, 21, the information leaflets 3, 4 are no longer held together and can be detached from one another or can detach from one another themselves. After unfolding the folds 12, the user can perceive the information on the respective information leaflets 3, 4.

FIG. 7 schematically shows a perspective view of the bundle 2 as the final product of the first preferred embodiment of the method in accordance with the invention. For the bundle 2 with the two different information leaflets 3, 4, the information leaflets 3, 4 are folded jointly and into one another. The two information leaflets 3, 4 have a protruding fold 14 which is cut for separation of the information leaflets 3, 4, and thus, forms a protruding edge region 27.

The bundle 2 is preferably held together by the joint folding and the adhesive.

The information leaflets 3, 4 differ from one another with respect to visible information and the size, especially the extension in the longitudinal direction 5 of the sheet of paper 1. The information leaflets 3, 4 can however also differ from one another in their shape, their color and/or their thickness.

Preferably, one of the information leaflets 3, 4 provides regulatory information and the other information leaflet 4, 3 provides handling instructions. In another preferred embodiment, the two information leaflets 3, 4 provides regulatory information which is, for example, different or which is directed at different recipients. Furthermore, it has proven advantageous if one of the information leaflets 3, 4 provides information for medical personnel, especially a physician or pharmacist, and the other information leaflet 4, 3 provides information for a patient.

In the preferred exemplary embodiment of a bundle 2 in accordance with the invention which is shown in FIG. 7, the protruding separated fold 14 is divided, especially cut.

Figure 8:
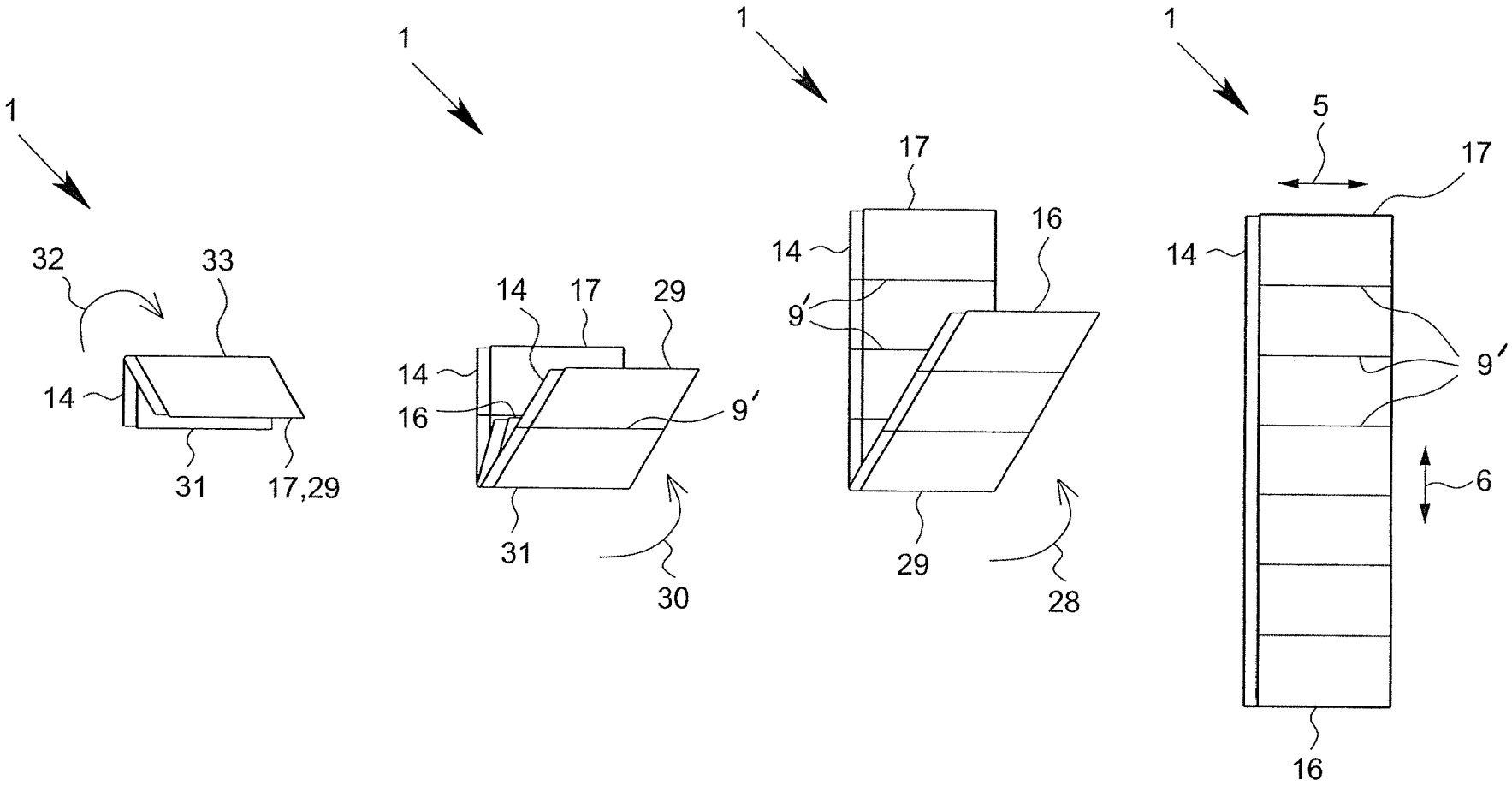

FIG. 8 schematically shows a partial sequence of a second preferred embodiment of the method in accordance with the invention using a second sheet of paper 1.

The second sheet of paper 1 has a different size from the first sheet of paper 1. The second sheet of paper 1 also has different sections which form different information leaflets 3, 4. Texts 7 and pictures 8 are printed beyond the folding lines 9 in the second sheet of paper 1.

The second sheet of paper 1 is shown in FIG. 8 in a form which has already been folded in the longitudinal direction 5 of the second sheet of paper 1. Previously the second sheet of paper 1 had been folded parallel along several, preferably five parallel folding lines 9 which run in the transverse direction 6, by means of fanfolding. In doing so, folds 12, fold layers 13 and a protruding fold 14 have been formed. The folds 12 are preferably aligned to one another or brought into a line.

For purposes of better clarity, FIG. 8 shows only one fold layer of the second sheet of paper 1 so that the already folded sheet of paper 1 in FIG. 8 appears very thin or even two-dimensional. The fact that the illustrated partial sequence increases the thickness of the respective intermediate product, remains ignored in FIG. 8, emphasis being place on the protruding fold 14 which is shown greatly simplified in FIG. 8.

On the sheet of paper 1 which has been folded in the longitudinal direction 5, several, specifically six parallel longitudinally extending folding lines 9' that are spaced in the transverse direction 6 are shown in FIG. 8. According to the second preferred embodiment of the method in accordance with the invention, the sheet of paper 1 is then folded in the transverse direction 6. To do this, the sheet of paper 1 is first folded around the folding line 9' which is the third one in FIG. 8 from underneath toward a front of the sheet of paper 1, as indicated by the arrow 28. In doing so, the sheet of paper 1 is folded such that a lower edge 16 of the sheet of paper 1 lies on the folding line 9' which is uppermost in FIG. 8 and is aligned to it. In doing so, a first fold 29 of the second sheet of paper 1 is formed.

Then, the sheet of paper 1 is folded toward the front of the sheet of paper 1 (as indicated by the arrow 30) such that the first transverse fold 29 lies on one upper edge 17 or is aligned to it. In doing so a second transverse fold 31 is formed.

Finally, the sheet of paper 1 is folded toward the front of the sheet of paper 1 (as indicated by the arrow 32) such that the upper edge 17 with the first transverse fold 29 which has been aligned to it lies on the second transverse fold 31 or is aligned to it. In doing so a third transverse fold 33 is formed.

Figure 9:
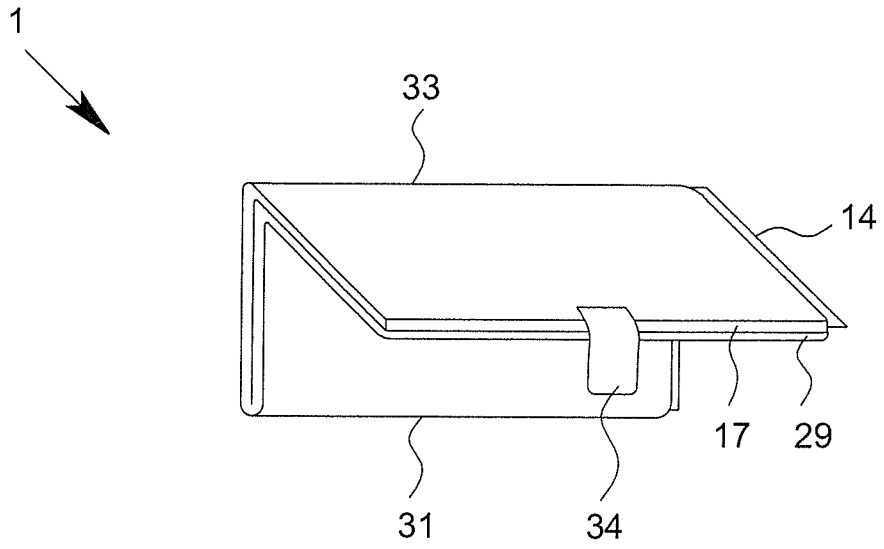
FIG. 9 is a schematic perspective view of the sheet of paper from FIG. 8 as the intermediate product after a further partial execution of the second preferred embodiment of the method in accordance with the invention.

After transverse folding of the sheet of paper 1, the folded sheet of paper 1 is detachably sealed using an adhesive. In the second preferred embodiment a label 34 is attached to the sheet of paper 1 for this purpose, preferably around a region of the second transverse fold 31 and of the upper edge 17 with the first transverse fold 29 aligned to it, as shown in FIG. 9, The label 34 is preferably transparent and/or is perforated in the longitudinal direction 5 of the sheet of paper 1.

Alternatively or in addition to the adhesive, a sealing means such as a stamp can also be used to seal the sheet of paper 1. The stamp can be applied for example, instead of a label 34 around the sheet of paper 1.

After transversely folding and sealing the sheet of paper 1, the protruding fold 14 is separated in order to separate the two information leaflets 3, 4 so that the information leaflets 3, 4 form the bundle 2.

Figure 10:
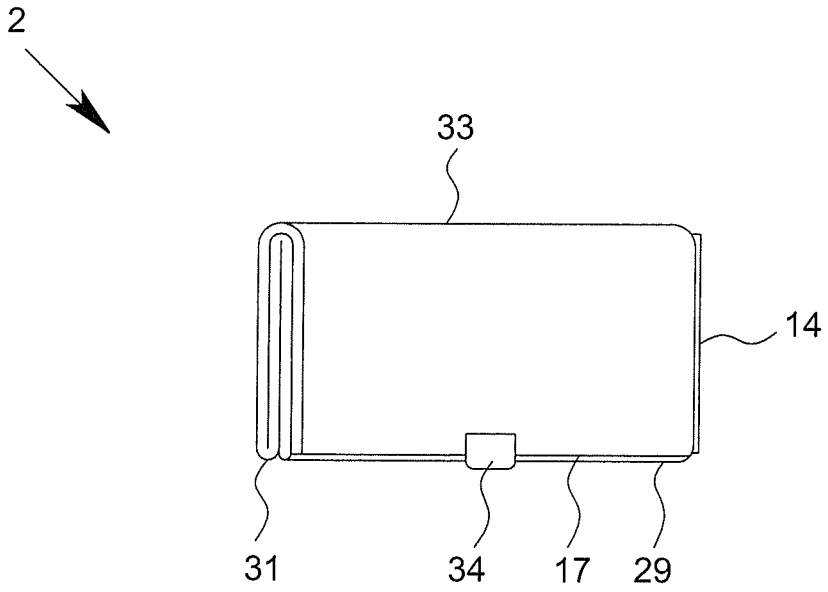
FIG. 10 is a schematic perspective view of a second embodiment of a bundle in accordance with the invention as the final product of the second preferred embodiment of the method in accordance with the invention.

FIG. 10 schematically shows a perspective view of a second preferred embodiment of a bundle 2 in accordance with the invention as the final product of the second preferred embodiment of the method in accordance with the invention.

The exemplary embodiments which are shown in FIGS. 1 to 10 constitute only one admittedly preferred subset of the versions of a method in accordance with the invention and of a bundle in accordance with the invention. In particular, versions which comprise other forms of the sheet, other folding techniques and other adhesives for sealing are not shown.

What is claimed is:

1. A method for producing a bundle of different information leaflets, comprising the steps of:

producing the bundle from a sheet of a flat material having at least two different sections which form the different information leaflets, folding the sheet in at least two folding processes, forming at least one protruding fold between sections of the sheet of flat material produced by said folding processes, wherein the protruding fold has a folded edge that protrudes beyond a folded edge of other folds formed with said sections of the sheet of flat material between which said at least one protruding fold is formed, and separating the information leaflets and forming the bundle of different information leaflets by separating the at least one protruding fold.

2. The method in accordance with claim 1, wherein, before folding, the different sections of the sheet are provided with different information in the form of at least one of different texts and different graphics.

3. The method in accordance with claim 1, wherein the sheet is folded by means of parallel folding along parallel folding lines by means of one of fanfolding, coil folding and altar folding.

4. The method in accordance with claim 3, wherein the sheet is folded first in a first direction and then the folded sheet is folded in a second direction which runs transversely to the first direction.

5. The method in accordance with claim 1, wherein the sheet is folded such that the at least one protruding fold protrudes at least by more than 2 mm.

6. The method in accordance with claim 1, wherein the protruding fold is separated by cutting off a strip from the protruding fold and thereby forming for each information leaflet at least one protruding edge region.

7. The method in accordance with claim 1, wherein after folding, the folded sheet is detachably sealed using an adhesive.

8. The method in accordance with claim 7, wherein the at least one protruding fold is separated after folding and sealing.

9. The method in accordance with claim 1, wherein there is at least one item of information on the at least one protruding fold and the at least one item of information is visible after separating the at least one protruding fold.

* * * * *